US008033434B2

(12) United States Patent
Bonner

(10) Patent No.: US 8,033,434 B2
(45) Date of Patent: Oct. 11, 2011

(54) PANTS HANGER

(76) Inventor: James D. Bonner, Copley, OH (US)

( * ) Notice: Subject to any disclaimer, the term of this patent is extended or adjusted under 35 U.S.C. 154(b) by 160 days.

(21) Appl. No.: 12/175,213

(22) Filed: Jul. 17, 2008

(65) Prior Publication Data

US 2009/0224010 A1 Sep. 10, 2009

Related U.S. Application Data

(60) Provisional application No. 61/034,682, filed on Mar. 7, 2008, provisional application No. 61/046,662, filed on Apr. 21, 2008.

(51) Int. Cl.
*A41D 27/22* (2006.01)

(52) U.S. Cl. ..... 223/96; 223/91

(58) Field of Classification Search ..... 223/85, 223/89, 90, 91, 93, 96, DIG. 2
See application file for complete search history.

(56) References Cited

U.S. PATENT DOCUMENTS

| | | | | | |
|---|---|---|---|---|---|
| 2,547,561 | A * | 4/1951 | Brooke | 223/91 |
| 2,775,378 | A * | 12/1956 | McLean | 223/91 |
| 2,998,173 | A * | 8/1961 | Lutz | 223/91 |
| 3,115,995 | A * | 12/1963 | McLean | 223/91 |
| 3,229,871 | A * | 1/1966 | Capo | 223/91 |
| 3,411,680 | A * | 11/1968 | Lundeen | 223/96 |
| 3,692,216 | A * | 9/1972 | Becca | 223/91 |
| 3,897,893 | A * | 8/1975 | Lemmenes | 223/91 |
| D295,579 | S | 5/1988 | Arnold | |
| 4,997,115 | A * | 3/1991 | Jolley | 223/89 |
| D320,700 | S | 10/1991 | Testa | |
| 5,361,949 | A | 11/1994 | Petrou | |
| 5,562,237 | A * | 10/1996 | Saliaris | 223/96 |
| 6,102,261 | A | 8/2000 | Tsai | |
| 6,286,734 | B1 | 9/2001 | Schneider | |
| 6,481,603 | B2 * | 11/2002 | Gish | 223/96 |

* cited by examiner

*Primary Examiner* — Gary L Welch
*Assistant Examiner* — Nathan Durham
(74) *Attorney, Agent, or Firm* — John D. Gugliotta, PE, Esq.

(57) ABSTRACT

A hanger includes a standard hook having a contoured shoulder section extending downward therefrom. A first, continuous and fixed shoulder terminates proximate to a flexible lower bar. The second shoulder terminates at a fixed, upper portion, but it remains connected to its lower portion by means of a tension arm therebetween. The lower portion of the second shoulder is continuous with and formed with the flexible lower bar such that a conventional hanger shape is formed. The tension arm, however, provides a means for the lower portion of the second shoulder to push upwards and away from the static portion so that an article of clothing can be secured between the lower bar and a horizontal, static arm that extends below it. A spring formed between the first shoulder and an egress in the lower bar closes the lower bar on the extension arm. The egress is gripped to press the lower bar against the first shoulder, wherein a gripping of the lower bar pushes the bottom portion of the second shoulder upwards so that clearance is formed between the lower bar and the arm so that pants can be slid therebetween.

21 Claims, 5 Drawing Sheets

PANTS HANGER

RELATED APPLICATIONS

The present application is a Continuation of U.S. Ser. No. 61/034,682, filed Mar. 7, 2008, and U.S. Ser. No. 61/046/662, filed Apr. 21, 2008. The present application claims a benefit to the provisional applications' priority dates. The present application furthermore incorporates all of the subject matter of the '682 and the '662 applications as if they are fully rewritten herein.

BACKGROUND OF THE INVENTION

1. Field of the Invention

The present invention relates to a clothes hanger and, more specifically, to a hanger that improves hanging of pants or pants-blouse combinations.

2. Description of the Related Art

Pluralities of different designed hangers are placed in wardrobes to suspend various styled articles of clothing. These hangers are designed with a variety of aims: to efficiently suspend clothing; to not wrinkle clothing; to not stretch clothing; and, to conserve space. Conventional wire and plastic hangers comprise inverted v-shaped shoulders that connect to a lower bar. These hangers are typically found in most closet spaces; however, they don't successfully accomplish the foregoing aims for work-dress attire. It is often a struggle to feed pants formed of soft, drapeable linens through conventional hangers. Slight movement causes fold-alignments to shift away from predominant creases. These fabrics wrinkle easily, so inadvertent misalignment can cause the pants to become unwearable on formal occasions. A further disadvantage is created when slight shifts in pants' weight cause them to slip off of the conventional hanger.

A shift towards service sector jobs in the past few decades has created an increase in the number of white collar professionals that appropriately dress in casual-to-formal work attire. A need is thus felt for better accommodation of this attire. The present invention teaches a pants hanger that most effectively suspends pants in a manner that preserves its shape. A search of the prior art reveals no references that teach the features of the present invention; however, the following patents are considered related:

U.S. Pat. No. 5,361,949 to Petro teaches a "pants hanger with pivotable finger on lower bars" that comprises a lower bar coupled to an upper bar, and a finger pivotally joined proximate to their adjacent surfaces which capture a garment;

U.S. Design No. D295,579 to Arnold teaches a "hanger for pants, skirts or the like" that shows an arm extension below a conventional hanger's lower bar which closes against it to capture a garment;

U.S. Pat. No. 6,102,261 to Tsai teaches a "pants hanger" that comprises a spring element biasing a horizontally extended gripping arm against a horizontally extended base arm, wherein the spring element is attached at a center of the gripping arm to allow for rotation of that arm thereon so even pressure is provided against an article of clothing between the two arms; and, U.S. Pat. No. 6,286,734 to Schneider teaches a "clothes hanger with a pants holding device" having a flexible spring element that extends somewhat parallel to a crossbar. Interlocking openings release and clamp the spring element from and to the cross bar. A disadvantage to Schneider is that pants must still be fed through the space formed between the shoulders and the lower bar.

The present invention provides a hanger having a flexible lower bar that releasably clamps on a stationary extension arm below it to close on an article. A spring exerts pressure on the grasping, lower bar to pull an opposing shoulder upwards to provide clearance for the article to be slipped between the bar and the arm. The spring is released for the former to close on the latter, so that the article is secured therebetween.

SUMMARY OF THE INVENTION

It is an object of the present invention to provide an improved clothes hanger that better hangs pants and pants-blouse combinations. It is an object to provide a means to more efficiently suspend soft, linen fabrics that are at a risk of falling off the conventional lower bars they drape. It is an object to provide a means to hang clothing without causing a shift away from the predominant crease on which they are folded. It is an object to provide a hanger that doesn't force pants stretch to manipulate them onto a hanger.

It is an object that the present invention provides a hanger that reduces the difficult steps required to hang pants on conventional hangers. It is an object to provide a hanger that is simple to manipulate and simple to use.

It is envisioned that a preferred embodiment of the present pants hanger includes a standard hook having a contoured shoulder section extending downward therefrom. A first, continuous and fixed shoulder terminates proximate to a flexible lower bar. The second shoulder terminates at a fixed, upper portion, but it remains connected to its lower portion by means of a tension arm therebetween. The lower portion of the second shoulder is continuous with and formed with the flexible lower bar such that a conventional hanger shape is formed. The tension arm, however, provides a means for the lower portion of the second shoulder to push upwards and away from the static portion so that an article of clothing can be secured between the lower bar and a horizontal, static arm that extends below it. A spring formed between the first shoulder and an egress in the lower bar closes the lower bar on the extension arm. The egress is gripped to press the lower bar against the first shoulder, wherein a gripping of the lower bar pushes the bottom portion of the second shoulder upwards so that clearance is formed between the lower bar and the arm so that pants can be slid therebetween.

A second embodiment of the invention only comprises a first contoured fixed shoulder portion that terminates at a cap which fits over a top of a vertical leg extending upwards from the extension arm. The grasping arm permanently affixes to a cylindrical, elongated base portion which extends upwards from its distal end to form an L-shaped body. The handle similarly extends upwards and outwards from a top of the base portion. The grasping arm is urged upwards by means of a spring mechanism. A spring is located within both the base portion and the vertical leg. Its upper distal end is coupled to the vertical leg. Its lower distal end terminates at a pin which is placed through an aperture on the base portion and a corresponding elongated slot on the vertical leg.

A third embodiment comprises the grasping arm hingedly coupled to the vertical leg at approximately where the later meets the extension arm. The handle extends upwards from an inside of the grasping arm. A tension means, s.a. e.g. a rubber band, is coupled to the grasping arm and the lower bar. The tension means forces the grasping arm towards the lower bar when the handle is got grasped. Applying pressure on the handle towards the hook weakens the tension on the tension means so that the grasping arm pivots away from the lower bar and an article of clothing can be placed therebetween.

BRIEF DESCRIPTION OF THE DRAWINGS

Advantages and features of the present invention are better understood with reference to the following and more detailed description and claims taken in conjunction with accompanying drawings, in which like elements are identified with like symbols.

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
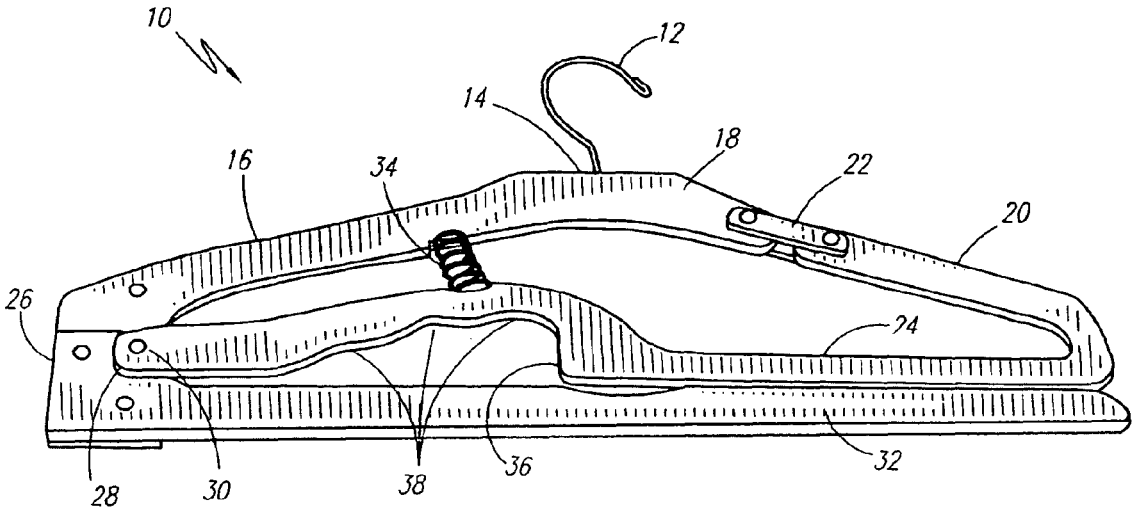
FIG. 1 is a front view of a pants hanger in accordance with a preferred embodiment of the present invention.
Figure 2:
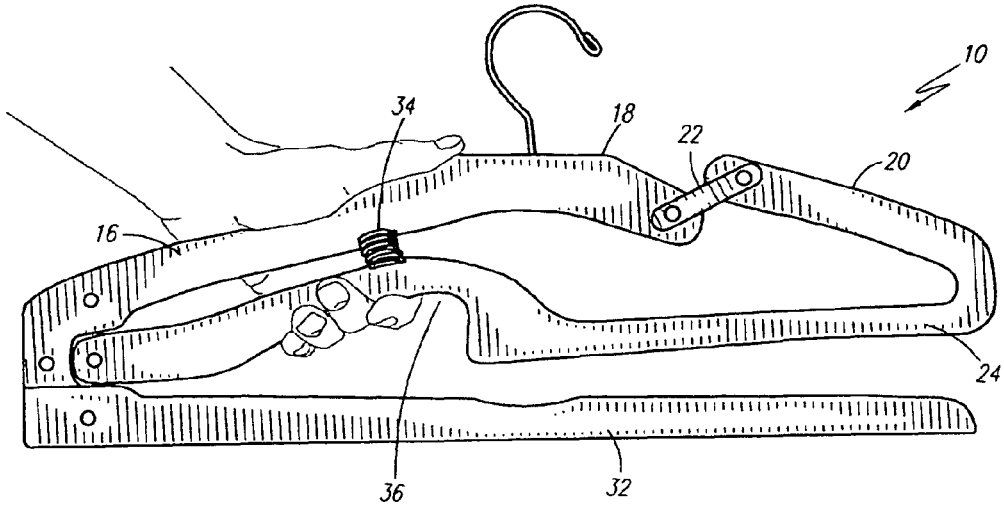
FIG. 2 is an operation of the pants hanger of FIG. 1.

A preferred embodiment of a pants hanger 10 is shown in FIGS. 1 and 2. A means to suspend 12 the hanger on a closet dowel (not shown) is located at the most upper apex. A hook is the most preferable hanging means 12; however, it is anticipated a nail hook, which mates on a corresponding dowel ring, may also be utilized with the present teachings.

The hook 12 terminates at a contoured shoulder body 14. The shoulder body 14 includes a first continuous, fixed shoulder portion 16 and an opposite, second and shorter fixed shoulder portion (hereinafter "upper portion 18") that terminates at approximately ⅓ to ½ of the former's length. A lower, moveable second shoulder portion (hereinafter "lower portion 20") continues the length of the upper portion 18 so that their combined length mirrors and matches the entire length of the first, fixed shoulder 16. A tension arm 22 connects to the terminal ends of both the upper and the lower shoulder portions 18, 20. The tension arm 22 pivots in a same plane for the both such that it moves the terminal end of the lower shoulder portion 20 above that of the upper shoulder portion 18 when the hanger 10 is operated.

The moveable lower shoulder portion 20 is pushed upwards at the pivoting tension arm 22 when a flexible, lower bar 24 is grasped. The lower bar 24, or crossbar, extends horizontally across a bottom of the hanger body to interconnect the contoured shoulder portions. The lower bar is namely of a same body as the lower shoulder portion 20, but it is pivotally affixed to a generally vertical leg 26 that extends downward from a distal end of the first shoulder portion 16. In this manner, a generally conventional hanger shape is formed.

Essentially, the leg 26 comprises a generally c-shaped channel 28 that encircles the distal end 30 of the lower bar 24. The channel 28 is slightly greater in dimension than a width of the lower bar 24 so that it provides clearance for the lower bar to slightly pivot back-and-forth therein.

A generally horizontal and fixed extension arm 32 extends outwards from the most distal portion of the leg 26. The fixed extension arm 32 is a same length or slightly longer than the lower bar 24 and an underside of the latter rests on a top side of the former. An article of clothing, and more specifically pants legs, is suspended between the lower bar 24 and the extension arm 32. The lower bar 24 clamps down on the extension arm 32 to secure the clothing therein.

The features that provide for an operation of the present invention are unique. An operation of the present hanger 10 is shown in FIG. 2. A spring 34 formed between the first shoulder 16 and an egress 36 in the lower bar 24 closes the lower bar 24 on the extension arm 32 below it. The egress 36 permits fingers of a hand to fit therethrough so that a user can grip the flexible lower bar 24 to press it against the first shoulder 16. A gripping of the lower bar 24 pushes the lower portion 20 of the second shoulder upwards so that clearance is formed between the lower bar 24 and the extension arm 32 when pants are slid therebetween.

The spring 34 extends outwards when it is in its natural position; hence, the spring pushes the lower bar 24 against the extension arm 32. The helical spring 32 compresses when the egress 36, which is essentially a handle, is grasped and pressure is placed on it. The user grasps the hanger 10 with the outer first shoulder portion 16 resting in his or her palm, while his fingers clench the egress portion 36 towards the palm. The egress may comprise a waved series of indentations 38 that accommodate individual fingers so that a manipulation of the hanger is more ergonomic.

After the pants are hung on the hanger 10, it is anticipated that a blouse or a jacket can be hung on the contoured shoulder portion in a manner similar to conventional hangers.

Figure 3:
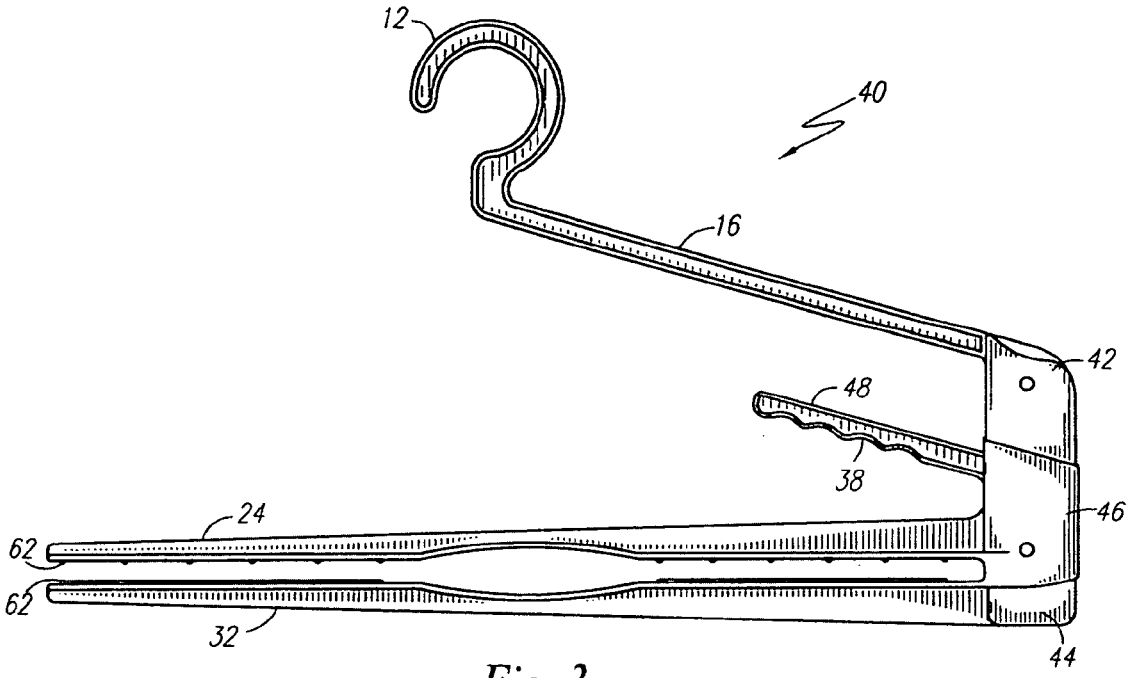
FIG. 3 is a front view of a second embodiment of the invention.
Figure 4:
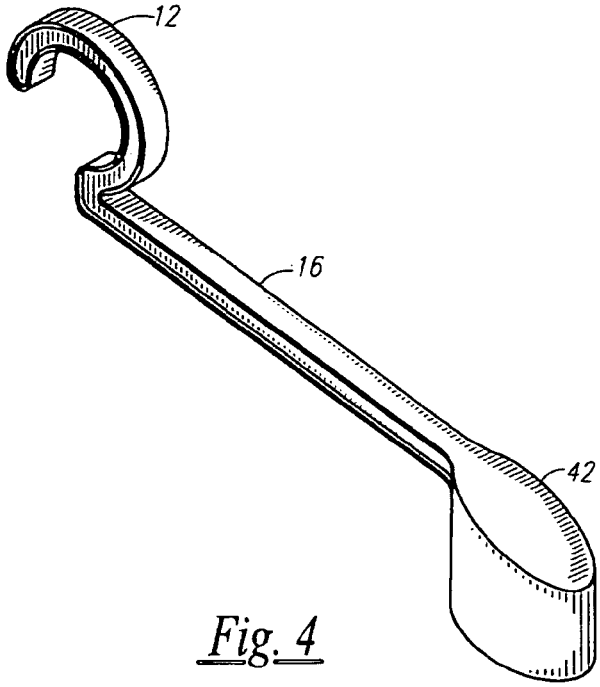
FIG. 4 is a perspective view of the shoulder portion of the hanger in FIG. 3.
Figure 5:
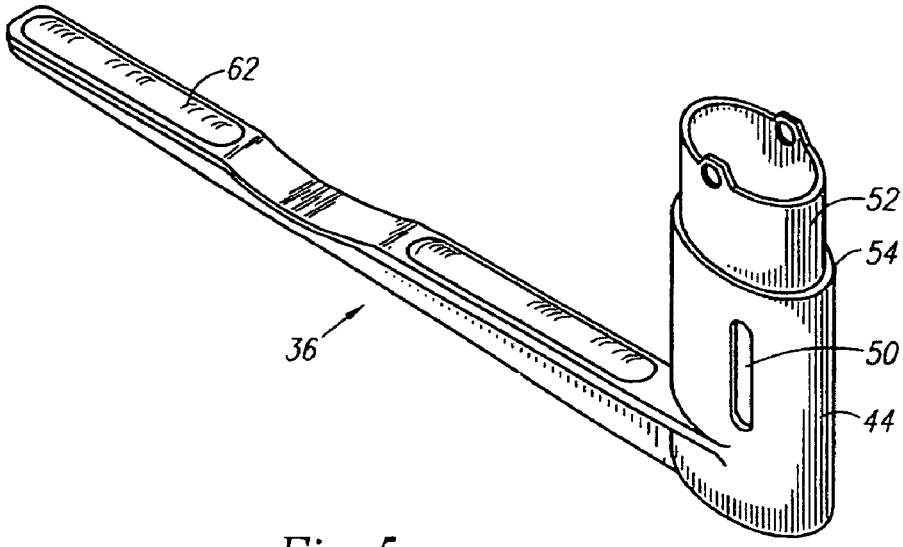
FIG. 5 is a perspective view of the extension arm portion of the hanger in FIG. 3.

A second embodiment 40 of the present invention is shown FIG. 3. The second embodiment similarly comprises the hook 12, a first fixed shoulder 16, and a lower bar 24 (hereinafter a "grasping arm") that clamps down on a parallel extension arm 32 to secure clothing therebetween. The shoulder 16 terminates at a vertical, rather cylindrically shaped cap 42 (FIG. 4), which fits over a corresponding vertical leg 44 extending upwards from a first distal end of the extension arm 32 (FIG. 5). The vertical leg 44 and the extension arm 32 form a generally L-shaped body. A top 52 of the vertical leg 44 is recessed inward to accommodate receipt of the cap 42. A lip 54 of the top 52 terminates a travel of the cap 42.

Figure 6:
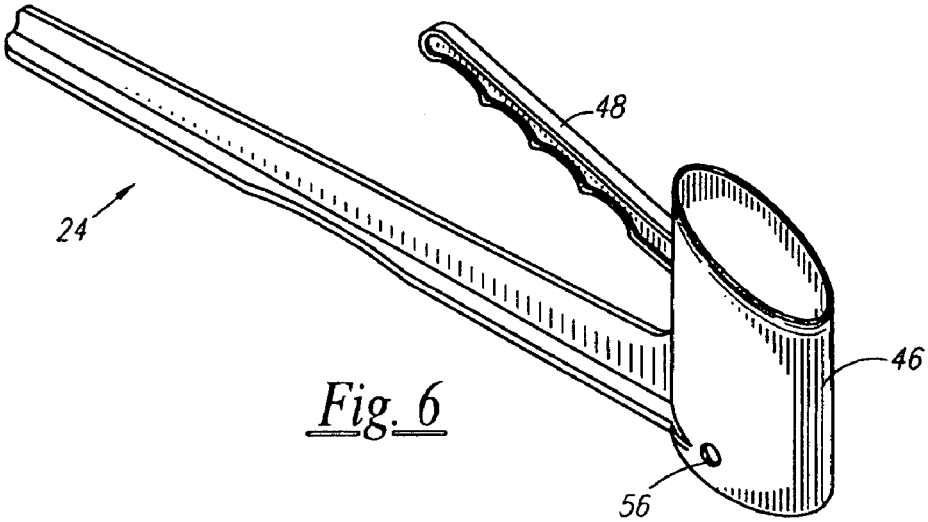
FIG. 6 is a perspective view of the grasping arm portion of the hanger in FIG. 3.

The features of the grasping arm 24 are shown in FIG. 6. The grasping arm 24 is permanently affixed to a cylindrical, elongated base portion 46 that extends upwards from its distal end to also form an L-shaped body. This grasping arm's base portion 46 fits around the vertical leg 44 of the extension arm 32. A handle 48, very similar to the egress 36 of the first embodiment (refer to FIG. 1), extends upwards and outwards from a top of the base portion such that it is in the same vertical plane as the fixed shoulder 16 and the grasping arm 24. The handle 48 is shown parallel with the shoulder 16, but there is no limitation to its angle of travel or to its length. The handle 48 may comprise a waved series of indentations 38 that accommodate individual fingers so that a manipulation of the hanger is more ergonomic.

Figure 7:
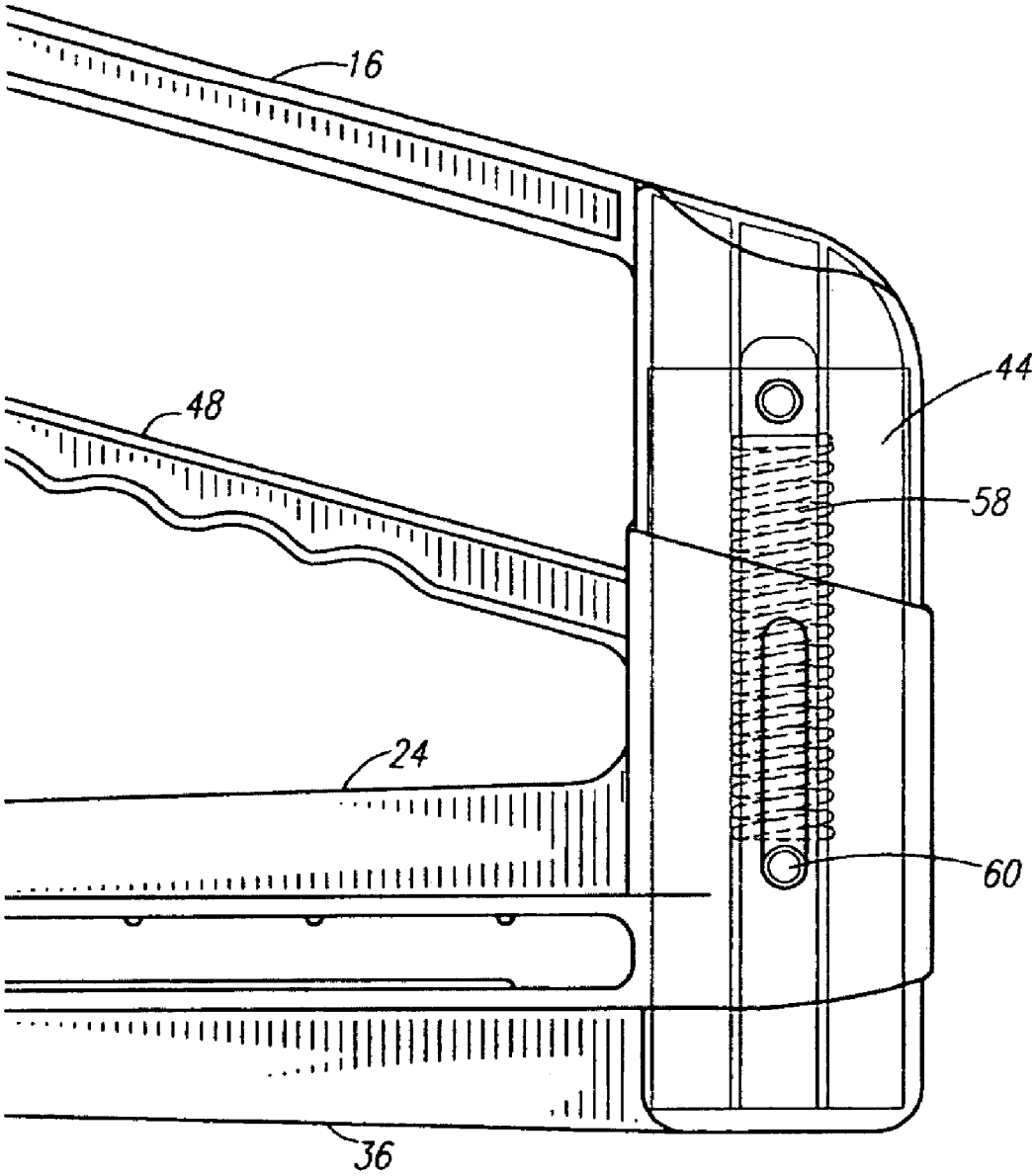
FIG. 7 is a perspective view of an internal spring system of the hanger in FIG. 3.

FIG. 5 shows an elongated slot 50 formed on a front facing portion of the vertical leg 44 and at a night angle to the extension arm 32. The elongated slot 50 secures the vertical leg 44 to the grasping arm's base portion 46. A corresponding aperture 56 on the base portion 46 lines up with the elongated slot 50. An internal spring system, shown in FIG. 7, comprises a spring 58 located within both the base portion 46 and the vertical leg 44. The upper distal end of the spring 58 is coupled to the vertical leg 44. The spring 58 terminates at a pin 60 that is placed through the aperture 56 and the elongated slot 50.

To operate the second embodiment, the handle 48 is grasped in a similar manner as previously described for the first embodiment, wherein a user's palm wraps around the fixed shoulder 16. A grasping of the handle 48 lowers pressure of the spring 58 to pull the grasping arm 24 upwards. The pin 60 is travels upwards the elongated slot 50. In this manner, the base portion 46 lifts with the grasping arm 24 too. An article of clothing is placed between the grasping arm 24 and the extension arm 32. The handle 48 is released to increase the spring's pressure. The article of clothing is retained on the hanger when the grasping arm 24 clamps down on the extension arm 32.

A further feature that may be incorporated into the shared embodiments includes a frictional surface 62 on surfaces of the grasping arm 24 and the extension arm 32 that face each other. This frictional surface further ensures the article of clothing stays between the arms 24, 32.

Figure 8:
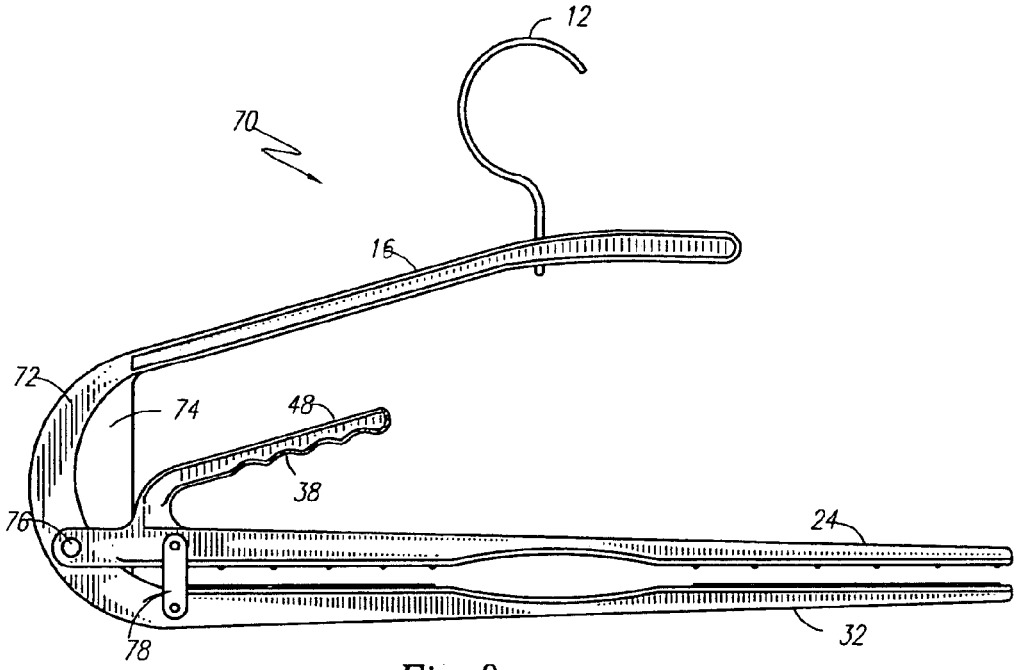
FIG. 8 is a front view of a third embodiment of the present invention.

A third embodiment 70 of the present invention is shown in FIG. 8. The hook 12, or similar hanging means, connects to an upper distal end of a fixed shoulder 16. A vertical leg 72 extends downwards from an opposite distal end of the fixed shoulder 16. A fixed lower bar 32 (simultaneous to "the extension arm") extends perpendicularly outwards from the lowest-resting end of the vertical leg 72. The shoulder 16, the vertical leg 72 and the lower bar 32 rest in a same vertical plane. The third embodiment 70 similarly comprises a grasping arm 24 that clamps downwards on the lower bar 32. The grasping arm 24 is hingedly coupled to the vertical leg 72 at approximately where it meets the lower bar 32. It is also possible to couple the grasping arm 24 to an adjacent support unit 74 that gives added support to the hanger. A pivot 76, or a similar coupling means, hingedly couples the grasping arm 24 to the vertical leg 72 so that the former can be pulled to pivot upwards. The pivot 76 is most preferably a screw with a threaded top. A handle 48 extends upwards from an inside of the grasping arm 24. A tension means 78, s.a., e.g., a rubber band, is coupled to the grasping arm 24 and the lower bar 32 at its both distal ends, respectively. The tension means 78 forces the grasping arm 24 towards the lower bar 32 when the handle 48 is got grasped. Applying pressure on the handle 48 towards the hook 12 weakens the tension on the tension means 78 so that the grasping arm 24 pivots away from the lower bar 32 and an article of clothing can be placed therebetween.

Figure 9:
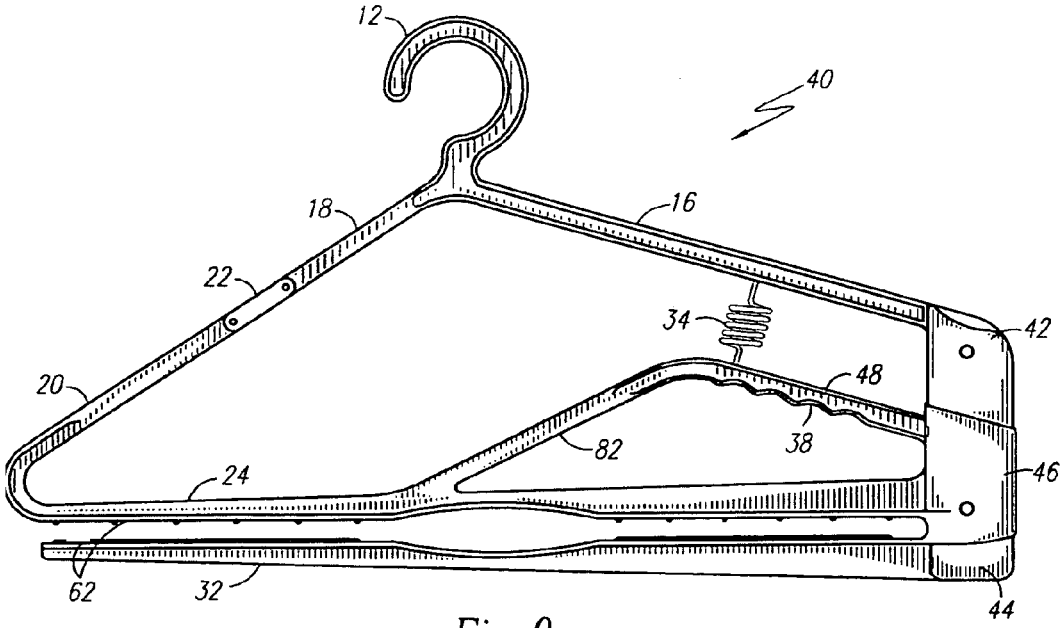
FIG. 9 is a front view of a fourth embodiment of the present invention.

A fourth embodiment 80 of the present invention is shown in FIG. 9 to combine elements of the first and second embodiments. This embodiment provides more stability in that it comprises both the tension arm of the first embodiment and the spring mechanism of the second embodiment. A hook 12 terminates at a contoured shoulder body 14 that includes a first continuous, fixed shoulder portion 16 and an opposite, second and shorter fixed shoulder portion (hereinafter "upper portion 18"). The upper portion 19 terminates at approximately ⅓ to ½ of the fixed shoulder portion's 16 length. A lower, moveable second shoulder portion (hereinafter "lower portion 20") follows. A tension arm 22 connects to the terminal ends of both the upper and the lower shoulder portions 18, 20. The tension arm 22 pivots in a same plane for the both such that it moves the terminal end of the lower shoulder portion 20 above that of the upper shoulder portion 18 when the hanger 10 is operated.

The moveable lower shoulder portion 20 is pushed upwards at the pivoting tension arm 22 when a flexible, grasping arm 24 is grasped. The grasping 24, or crossbar, extends horizontally across a bottom of the hanger body to interconnect the contoured shoulder portions. The lower bar is namely of a same body as the lower shoulder portion 20, but it is affixed to a generally vertical leg 44 that extends downward from a distal end of the first shoulder portion 16. In this manner, a generally conventional hanger shape is formed. The first shoulder 16 actually terminates at a vertical, rather cylindrically shaped cap 42, which fits over the corresponding vertical leg 44 extending upwards from a first distal end of the extension arm 32. The vertical leg 44 and the extension arm 32 form a generally L-shaped body. A top 52 of the vertical leg 44 is recessed inward to accommodate receipt of the cap 42. A lip 54 of the top 52 terminates a travel of the cap 42.

The grasping arm 24 is permanently affixed to a cylindrical, elongated base portion 46 that extends upwards from its distal end to also form an L-shaped body. This grasping arm's base portion 46 fits around the vertical leg 44 of the extension arm 32. A handle 48 extends upwards and outwards from a top of the base portion 46 such that it is in the same vertical plane as the fixed shoulder 16 and the grasping arm 24. The handle 48 is shown parallel with the shoulder 16, but there is no limitation to its angle of travel or to its length. The handle 48 may comprise a waved series of indentations 38 that accommodate individual fingers so that a manipulation of the hanger is more ergonomic.

An elongated slot is formed on a front facing portion of the vertical leg 44 and at a right angle to the extension arm 32. The elongated slot secures the vertical leg 44 to the grasping arm's base portion 46. A corresponding aperture 56 on the base portion 46 lines up with the elongated slot 50. An internal spring system comprises a spring located within both the base portion 46 and the vertical leg 44. The upper distal end of the spring is coupled to the vertical leg 44. The spring terminates at a pin that is placed through the aperture 56 and the elongated slot 50.

A spring 34 formed between the first shoulder 16 and the handle 48 closes the grasping bar 24 on the extension arm 32 below it. The handle 48 permits fingers of a hand to fit therethrough so that a user can grip the grasping arm 24 to press it against the first shoulder 16. A gripping of the grasping arm 24 pushes the lower portion 20 of the second shoulder upwards so that clearance is formed between the grasping arm 24 and the extension arm 32 when pants are slid therebetween.

The spring 34 extends outwards when it is in its natural position; hence, the spring pushes the grasping arm 24 against the extension arm 32. The helical spring 32 compresses when the handle 48 is grasped and pressure is placed on it. The user grasps the hanger 80 with the outer first shoulder portion 16 resting in his or her palm, while his fingers clench handle 48 towards the palm. The handle 48 may comprise a waved series of indentations 38 that accommodate individual fingers so that a manipulation of the hanger is more ergonomic.

To provide yet further support, a support member 82 may extend from the outside distal end of the handle 48 and connect to the grasping arm 24 at anywhere along its length.

After the pants are hung on the hanger 80, it is anticipated that a blouse or a jacket can be hung on the contoured shoulder portion in a manner similar to conventional hangers.

It is preferred that the present hangers 10 are manufactured from plastic material, but they may alternatively be constructed from wood and other similarly functioning materials.

The foregoing descriptions of specific embodiments of the present invention are presented for purposes of illustration and description. They are not intended to be exhaustive or to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by the following exemplary claims nor by any possible, adverse inference under the rulings of *Warner-Jenkins Company v. Hilton Davis Chemical,* 520 US 17 (1997) or *Festo Corp. V. Shoketsu Kinzoku Kogyo Kabushiki Co.,* 535 U.S. 722 (2002), or other similar case law or subsequent precedent should not be made if such claims are amended subsequent to this Provisional Patent Application.

What is claimed is:

1. A pants hanger, comprising:

a means to suspend said hanger on a closet dowel;

a contoured shoulder body; said shoulder body comprises:

a first continuous, fixed shoulder portion and at opposite a second and shorter fixed shoulder portion; and, a lower, moveable second shoulder portion continuing a length of said second and shorter fixed shoulder portion so that their combined length mirrors and matches an entire length of said first continuous, fixed shoulder portion;

a pivoting tension arm connecting to terminal ends of both said second and shorter fixed shoulder portion and said lower, moveable second shoulder portion;

a flexible lower bar extending horizontally across a bottom of said hanger to interconnect said contoured shoulder body;

a generally horizontal and fixed extension arm below said flexible, lower bar; and a helical spring formed between said first continuous, fixed shoulder portion and an egress in said flexible lower portion, said egress permits fingers of a hand to fit therethrough so that a user can grip said flexible lower bar to press it against said continuous fixed shoulder portion;

wherein an underside of said flexible lower bar rests on a top side of said extension arm such that an article of clothing is suspended between said flexible lower bar and said extension arm when said flexible lower bar clamps down on said extension arm to secure the article of clothing therein and wherein a gripping of said flexible, lower bar pushes said lower, moveable second shoulder portion upwards so that clearance is formed between said flexible lower bar and said extension arm when the article of clothing is slid therebetween.

2. The pants hanger of claim 1, wherein said pivoting tension arm pivots in a same plane for said second and shorter fixed shoulder portion and said lower, moveable second shoulder portion, said pivoting tension arm moves a terminal end of said lower, moveable second shoulder portion above that of said second and shorter fixed shoulder portion when a user hangs the article of clothing on said hanger.

3. The pants hanger of claim 2, wherein said lower, moveable second shoulder portion is pushed upwards at said pivoting tension arm when said flexible, lower bar is grasped.

4. The pants hanger of claim 1, wherein said flexible, lower bar is namely of a same body as said lower, moveable second shoulder portion, but it is pivotally affixed to a generally vertical leg that extends downward from said first continuous, fixed shoulder portion.

5. The pants hanger of claim 4, wherein said vertical leg comprises a generally c-shaped channel that encircles a distal end of said flexible, lower bar, said channel is slightly greater in dimension than a width of said lower bar so that it provides clearance for said lower bar to slightly pivot back-and-forth therein.

6. The pants hanger of claim 5, wherein said generally horizontal and fixed extension arm extends outwards from a most distal portion of said vertical leg.

7. The pants hanger of claim 1, wherein said fixed extension arm is a same length or slightly longer than said flexible lower bar.

8. The pants hanger of claim 1, wherein said second and shorter fixed shoulder portion terminates at approximately ⅓ to ½ a length of said first continuous fixed shoulder portion.

9. The pants hanger of claim 1, wherein said means to suspend said hanger is a hook at its most upper apex.

10. The pants hanger of claim 1, wherein said means to suspend said hanger is nail hook at its most upper apex, said nail hook mates with a corresponding dowel ring to suspend said hanger on a closet dowel.

11. The pants hanger of claim 1, wherein said egress comprises a waved series of indentations that accommodate individual fingers so that a manipulation of said hanger is more ergonomic.

12. The hanger of claim 1, further comprising a frictional surface on surfaces of said lower bar and said extension arm that face each other.

13. A pants hanger, comprising:

a means to suspend said hanger on a closet dowel;

a contoured shoulder body; said shoulder body comprises;

a first continuous, fixed shoulder portion and at opposite a second and shorter fixed shoulder portion; and, a lower, moveable second shoulder portion continuing a length of said second and shorter fixed shoulder portion;

a pivoting tension arm connecting to terminal ends of both said second and shorter fixed shoulder portion and said lower, moveable second shoulder portion;

a grasping arm extending horizontally across a bottom of said hanger to interconnect said contoured shoulder body;

a generally horizontal and fixed extension arm below said flexible, lower bar;

a vertical leg extending upwards from an inside distal end of said extension arm; and a helical spring formed between said first continuous, fixed shoulder portion and an egress in said flexible lower portion, said egress permits fingers of a hand to fit therethrough so that a user can grip said flexible lower bar to press it against said continuous fixed shoulder portion;

wherein an underside of said grasping arm rests on a top side of said extension arm such that an article of clothing is suspended between said grasping arm and said extension arm when said grasping arm bar clamps down on said extension arm to secure the article of clothing therein and wherein a gripping or said flexible, lower bar pushes said lower, moveable second shoulder portion upwards so that clearance is formed between said flexible lower bar and said extension arm when the article of clothing is slid therebetween.

14. The hanger of claim 13, wherein said pivoting tension arm pivots in a same plane for said second and shorter fixed shoulder portion and said lower, moveable second shoulder portion, said pivoting tension arm moves a terminal end of said lower, moveable second shoulder portion above that of said second and shorter fixed shoulder portion when a user hangs the article of clothing on said hanger.

15. The hanger of claim 14, wherein said lower, moveable second shoulder portion is pushed upwards at said pivoting tension arm when said grasping arm is grasped.

16. The hanger of claim 13, wherein said flexible, lower bar is namely of a same body as said lower, moveable second shoulder portion, but it is affixed to said generally vertical leg that extends downward from said first continuous, fixed shoulder portion.

17. The pants hanger of claim 13, wherein said fixed extension arm is a same length or slightly longer than said grasping arm.

18. The hanger of claim 13, wherein said second and shorter fixed shoulder portion terminates at approximately ⅓ to ½ a length of said first continuous fixed shoulder portion.

19. The hanger of claim 13, wherein said means to suspend said hanger is a hook at its most upper apex.

20. The hanger of claim 13, wherein said means to suspend said hanger is nail hook at its most upper apex, said nail hook mates with a corresponding dowel ring to suspend said hanger on a closet dowel.

21. The hanger of claim 13, further comprising a frictional surface on surfaces of said grasping arm and said extension arm that face each other.

* * * * *